US005749200A

United States Patent [19]

Fukuoka

[11] Patent Number: 5,749,200

[45] Date of Patent: May 12, 1998

[54] METHOD OF REINFORCING CONCRETE MADE CONSTRUCTION AND FIXTURE USED THEREFOR

[75] Inventor: Katsumi Fukuoka, Fukuoka, Japan

[73] Assignee: Kyouryou Hozen Inc., Fukuoka, Japan

[21] Appl. No.: 658,570

[22] Filed: Jun. 5, 1996

[30] Foreign Application Priority Data

Jun. 14, 1995 [JP] Japan ..... 7-172810

[51] Int. Cl.[6] ..... E04B 1/00

[52] U.S. Cl. ..... 52/741.1; 52/740.1; 52/665; 52/223.6; 411/399; 411/60

[58] Field of Search ..... 52/663, 664, 665, 52/676, 686, 741.1, 741, 41, 746.1, 223.6, 223.1, 223.14, 740.1; 14/73; 411/356, 357, 399, 41, 45, 60

[56] References Cited

U.S. PATENT DOCUMENTS

| | | | |
|---|---|---|---|
| 2,203,294 | 6/1940 | Engle . | |
| 3,456,549 | 7/1969 | Horton . | |
| 3,650,173 | 3/1972 | Mathe | 411/45 |
| 3,758,939 | 9/1973 | Galvani . | |
| 3,889,436 | 6/1975 | Elliott . | |
| 4,276,806 | 7/1981 | Morel | 411/41 |
| 4,288,956 | 9/1981 | Heck | 52/746.1 X |
| 4,392,335 | 7/1983 | Heiman . | |
| 4,512,123 | 4/1985 | Fischer . | |
| 4,711,234 | 12/1987 | Vives et al. . | |
| 4,714,507 | 12/1987 | Ohgushi . | |
| 4,976,577 | 12/1990 | Brown et al. | 411/45 X |
| 5,115,622 | 5/1992 | Ammann et al. . | |
| 5,163,795 | 11/1992 | Benoit et al. | 411/41 X |
| 5,352,002 | 10/1994 | Vouillon et al. . | |
| 5,424,152 | 6/1995 | Teron . | |
| 5,431,516 | 7/1995 | Haage et al. | 411/60 X |
| 5,440,859 | 8/1995 | Cortese . | |
| 5,457,839 | 10/1995 | Csagoly . | |

FOREIGN PATENT DOCUMENTS

| | | | |
|---|---|---|---|
| 1270236 | 4/1972 | United Kingdom | 411/357 |

*Primary Examiner*—Creighton Smith
*Attorney, Agent, or Firm*—Griffin, Butler, Whisenhunt & Kurtossy

[57] ABSTRACT

The present invention provides a method of reinforcing a concrete made construction having the step of fixedly securing a grating member acting as a reinforcement onto a surface of a concrete made construction with a fixture so that the fixture imparts tension force to the grating member in a plane of the grating member. The fixture comprises, for instance, an anchor and a pin. The anchor includes an insertion portion to be inserted into a concrete made construction, the insertion portion being formed at a distal end thereof with an expanding slot, an arc-shaped head portion, and a tapered portion connecting the insertion portion to the head portion and having a cross-sectional area increasing from insertion portion towards the head portion, a through hole being formed axially through the anchor. The pin is to be inserted into a concrete made construction through the through hole. The invention ensures fixation of a reinforcement such as a grating member onto a construction such as a bridge to which repeated live loads are always applied.

16 Claims, 4 Drawing Sheets

METHOD OF REINFORCING CONCRETE MADE CONSTRUCTION AND FIXTURE USED THEREFOR

BACKGROUND OF THE INVENTION

1. Field of the Invention

The invention relates to a method of reinforcing a concrete made construction with a reinforcement to be secured onto a lower surface of a beam or a floor of a concrete made construction such as a bridge. The invention also relates to a fixture to be used for such a method.

2. Description of the Prior Art

A floor of a bridge receives the largest load or stress among parts constituting the bridge, because moving loads of automobiles are directly applied thereto in repeated fashion. Thus, in particular on a lower surface of a floor, a crack running in a single direction is developed to cracks running in many directions, which are further developed like a net, resulting in spallation of concrete of which a bridge is made.

If such spallation is kept as it is, cracks are further developed with the result of corrosion of reinforcing steels which would finally cause the destruction of a construction such as a bridge. Accordingly, appropriate mending has been carried out in order to avoid such destruction when initial cracks are generated.

For instance, the followings have been conventionally carried out for mending a construction: introduction of epoxy resin into cracks of a floor of a bride so that epoxy resin becomes integral with concrete of which the bridge is made; formation of a layer such as a sheet and a coated film for preventing water such as rain from penetrating a floor of a bridge; application of fiber-reinforced plastics (FRP) to tension edges of a floor; and filling cavities or spallation with cement mortar or resin mortar.

Those mending ways ensure prevention of degradation of concrete and corrosion prevention of reinforcing steels to some degree. However, those mending ways as mentioned above merely mend of a construction, and do not enhance the strength of a construction.

In order to resolve such a problem, the inventor has suggested a method of mending and reinforcing a construction such as a floor of a bridge in Japanese Unexamined Patent Publication No. 61-146904. This method includes the steps of applying a surface application material onto a surface of a construction which has been cleaned, covering the surface with a wire gauze and applying again a surface application material over the wire gauze.

FIG. 1 is a cross-section illustrating a construction mended and reinforced by the method disclosed in the Publication No. 61-146904. A floor 21 of a construction is covered with a first impregnated layer 22, which is covered with a second impregnated layer 23. A wire gauze 24 is fixed over the second impregnated layer 23 with hole-in anchors 25. The wire gauze 24 is further covered with a first application layer 26, which is in turn covered with a second application layer 27.

In order for the wire gauze 24 covering the second impregnated layer 23 to act sufficiently as a reinforcement, it is necessary for the wire gauze 24 to be sufficiently fixed to the floor 21 by means of the hole-in anchors 25. Such fixation of the wire gauze 24 to the floor 21 ensures almost the same strength as the strength of a construction originally including reinforcing steels corresponding in amount to the wire gauze 24.

The method disclosed in the above mentioned Publication uses the bolt-shaped hole-in anchors 25, which sandwich an intersection of the wire gauze 24 between a head portion **25*a* and a threaded portion 25*b* thereof for fixing the wire gauze 24. This method cannot provide sufficient fixation of the wire gauze 24**.

As mentioned earlier, repeated live loads are always applied to a concrete floor of a bridge by vehicles passing thereon, and cause the concrete floor to repeat vertical deflection with maximum deflection occurring at a center of a span of the bridge. Thus, if the bolt-shaped hole-in anchors 25 are used for fixing the wire gauze 24, there will be produced a gap between the hole-in anchors 25 and the wire gauze 24 as times go by, resulting in that it is no longer possible to sufficiently distribute the loads applied to the floor 21 to the wire gauze 24.

SUMMARY OF THE INVENTION

In view of the above mentioned problem of the prior art, it is an object of the present invention to provide a method of certainly fixing a reinforcement to a construction such as a bridge to which repeated live loads are always applied. It is also an object of the present invention to provide a fixture to be used in such a method.

In one aspect, the present invention provides, a method of reinforcing a concrete made construction including the step of fixedly securing a grating member acting as a reinforcement onto a surface of a concrete made construction with a fixture so that the fixture imparts tension force to the grating member in a plane of the grating member.

It is preferable that the tension force imparted by the fixture is externally directed from a point at which the concrete made construction has a maximum deflection caused by loads to be applied thereto.

The grating member acting as a reinforcement is made preferably of reinforcing steel or resin.

In another aspect, the present invention provides a fixture to be used for a method of reinforcing a concrete made construction having the step of fixedly securing a grating member acting as reinforcement onto a surface of the concrete made construction with a fixture, the fixture comprising an anchor and a pin, the anchor including: an insertion portion to be inserted into a concrete made construction, the insertion portion being formed at a distal end thereof with an expanding slot; an arc-shaped head portion; and a tapered portion connecting the insertion portion to the head portion and having a cross-sectional area increasing from the insertion portion towards the head portion, a through hole being formed axially through the anchor, the pin being to be inserted into a concrete made construction through the through hole.

By inserting the above mentioned fixture into a concrete made construction along an intersection of a grating member, the grating member in contact with the fixture is made to externally move along a surface of the tapered portion of the anchor to thereby impart the tension force to the grating member in a direction of a plane of the grating member.

The present invention further provides a method of reinforcing a concrete made construction including the steps of (a) fixedly securing a grating member acting as reinforcement onto a surface of a concrete made construction with a fixture, the fixture including: an insertion portion to be inserted into a concrete made construction; a head portion; and a tapered portion connecting the insertion portion to the head portion and having a cross-sectional area increasing from the insertion portion towards the head portion, the fixture being to be inserted into the concrete made construction with the tapered portion being made to be engaged to intersections of the grating member so that the fixture imparts tension force to the grating member in a direction of a plane of the grating member, and (b) forming a layer for covering the grating member therewith.

When reinforcing steels are to be used as the grating member, it is preferable to form the above mentioned layer by applying covering material onto the grating member after the grating member has been fixed with a fixture such as the above mentioned one, in order to avoid the reinforcing steels from being exposed to atmosphere and hence prevent the reinforcing steels from being rusted. The covering material of which the layer is made includes polymer cement mortar providing superior adhesion to a surface of a concrete made construction. The layer can be formed, for instance, by direct application of polymer cement mortar to a concrete made construction, positioning a frame onto a surface of a concrete made construction and introducing polymer cement mortar into the frame, or spraying polymer cement mortar to a surface of a concrete cement mortar.

It is preferable to construct the above mentioned layer of a multi-layer structure including a base application layer applied onto a lower surface of a concrete made construction, an intermediate application layer lying over the base application layer so that the intermediate layer covers a mesh-type reinforcing steel to be laid onto the base application layer, and an upper application layer lying over the intermediate application layer. The base application layer increases the strength of a lower surface of a concrete made construction, enhances corrosion prevention effect of reinforcing steels embedded in a concrete made construction, and increases adhesive force between reinforcing steels and a concrete made construction. The intermediate application layer provides rust prevention effect to the mesh-type reinforcing steel and decreases salt damage of the mesh-type reinforcing steel. The upper application layer provides neutralization prevention effect, salt damage prevention effect, alkali-aggregate reaction prevention effect and low water-permeability effect.

Specifically, it is preferable to use FK-A (base application) commercially available from Kyouryo Hozen K. K. for the base application layer, FK-A (intermediate application) for the intermediate application layer, and FK-A (upper application) for the upper application layer.

FIG. 2A illustrates a grating member fixed to a concrete made construction in accordance with the method of the present invention, whereas FIG. 2B illustrates a grating member fixed to a concrete made construction with a conventional fixture. As is understood by comparison of FIGS. 2A and 2B, there is not generated a gap between a mesh-type reinforcing steel 5 acting as a grating member and a fixture 6 in FIG. 2A, whereas there are always generated a gap between the mesh-type reinforcing steel 5 and a fixture 25 in FIG. 2B, resulting in that it is impossible to distribute stresses to the mesh-type reinforcing steel 5 from a concrete made construction.

By fixing the mesh-type reinforcing steel to a concrete made construction with tension force being imparted to the mesh-type reinforcing steel in a plane thereof, there is introduced so-called pre-stress into the mesh-type reinforcing steel. Thus, even if a concrete made construction to which the mesh-type reinforcing steel is secured is deflected, the mesh-type reinforcing steel moves following the deflection of the construction, thereby a gap being never generated between the mesh-type reinforcing steel and a fixture.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 1:
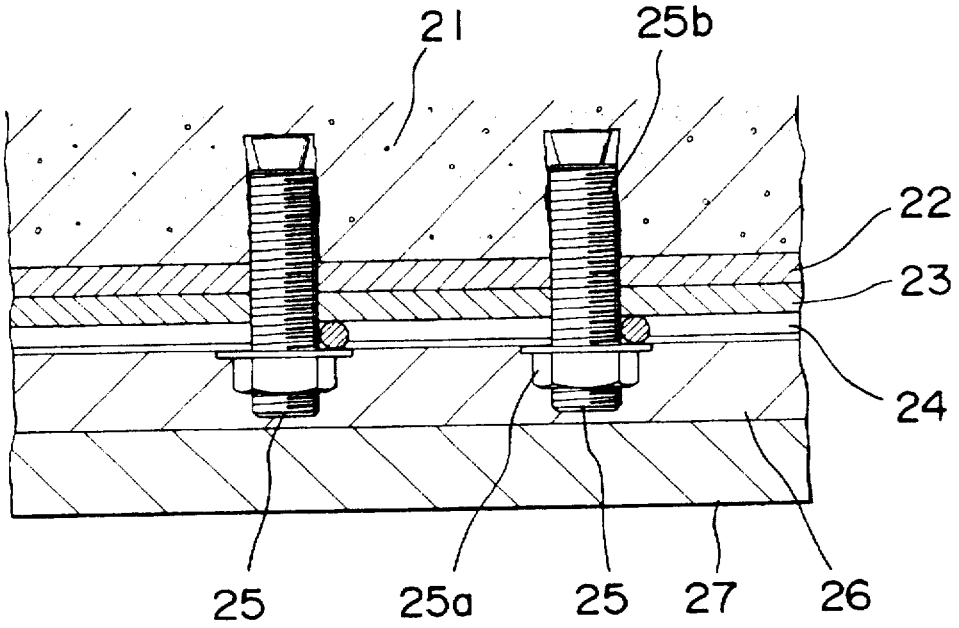
FIG. 1 PRIOR ART
FIG. 1 is a cross-sectional view illustrating a concrete made construction reinforced by a conventional method.
Figure 2A:
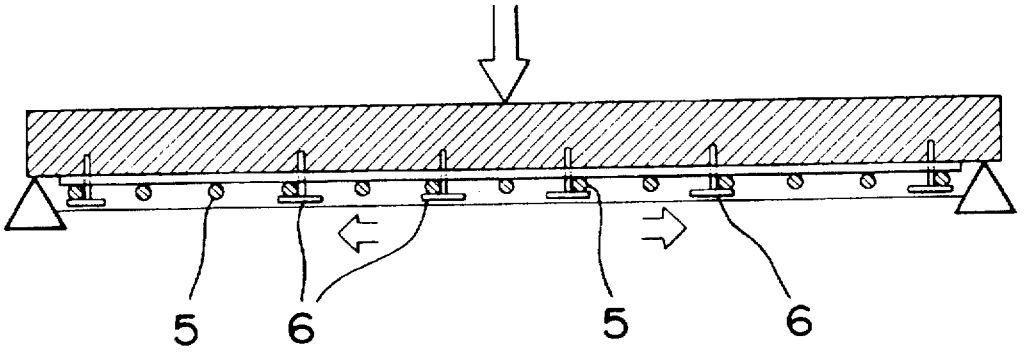
FIG. 2A is a schematic view illustrating a grating member fixed to a concrete made construction in accordance with the method of the present invention.
Figure 2B:
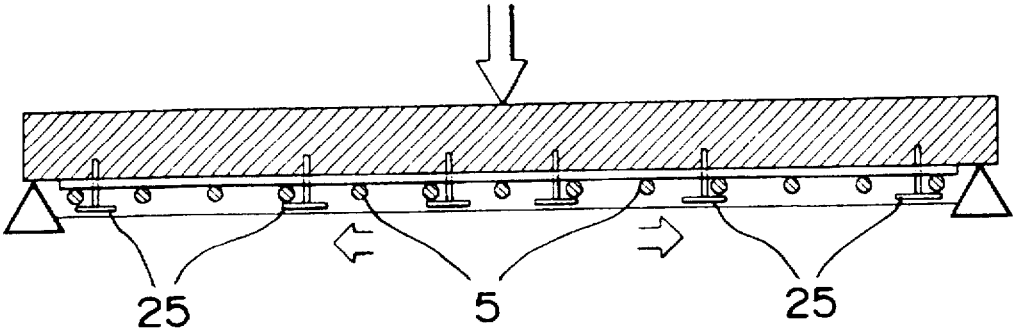
FIG. 2B is a schematic view illustrating a grating member fixed to a concrete made construction with a conventional fixture.
Figure 3:
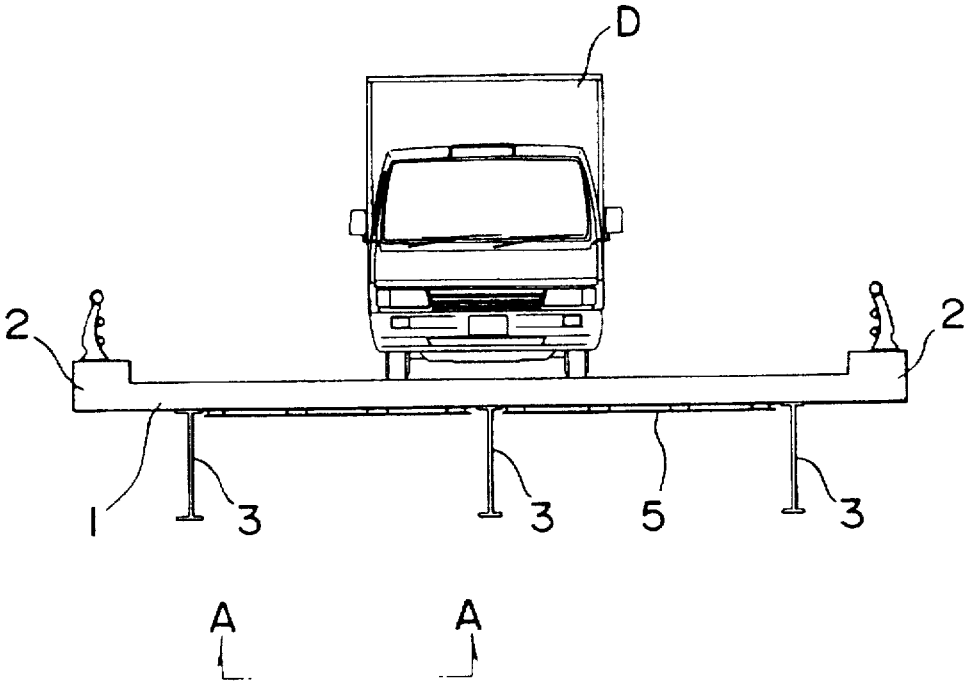
FIG. 3 is a front view illustrating a bridge to which a fixture made in accordance with the present invention is applied.

With reference to FIG. 3, a concrete floor 1 of a bridge is reinforced with steels and is formed at opposite edges thereof with raised portions 2. The floor 1 is supported at a lower surface thereof with three pillars 3. A truck D as live load runs on the floor 1.

Figure 4:
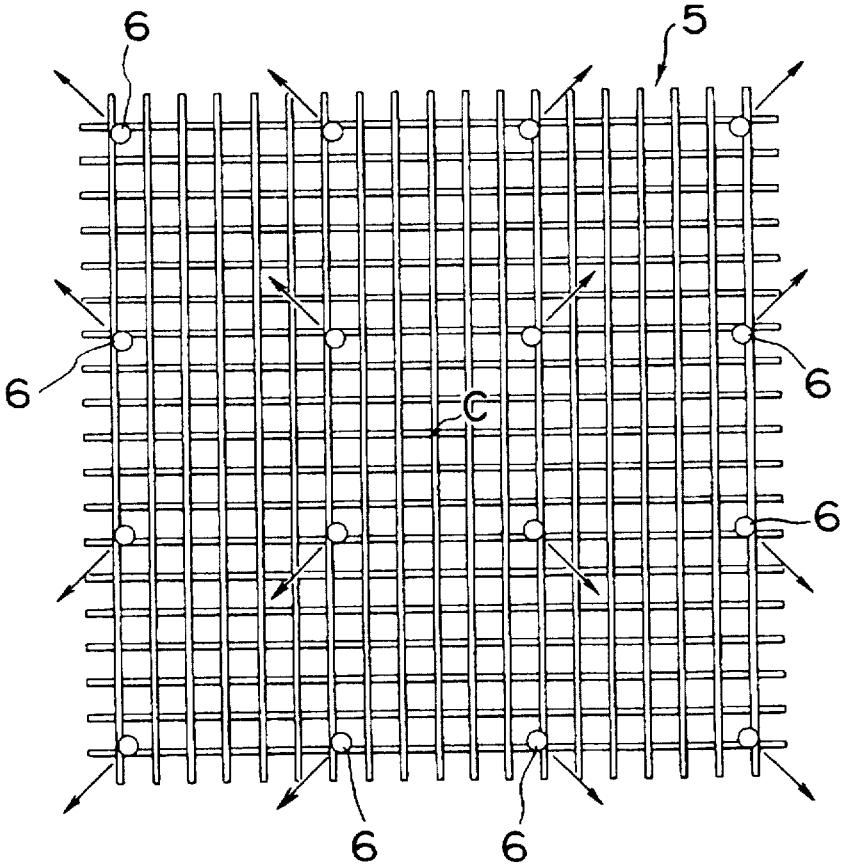
FIG. 4 is an enlarged view as viewed in a direction indicated with arrow A in FIG. 3.
Figure 6:
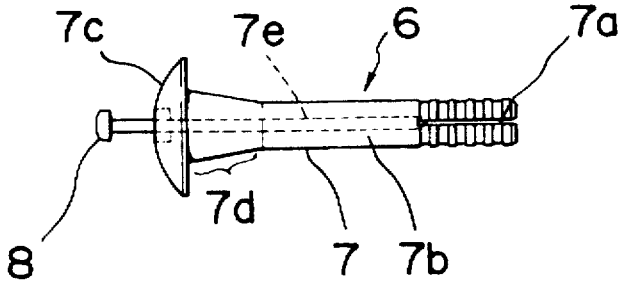
FIG. 6 is a plan view of a fixture made in accordance with the present invention.

As illustrated in FIG. 4, a mesh-type reinforcing steel 5 is fixed over a lower surface of the floor 1. The mesh-type reinforcing steel 5 is formed by crossing reinforcing steels having a diameter ranging from 6 mm to 13 mm like a net, and welding intersections of the reinforcing steels. The mesh-type reinforcing steel 5 is fixed onto the floor 1 by means of a plurality of fixtures 6. As best illustrated in FIG. 6, the fixture 6 is comprised of an anchor 7 and a pin 8. The anchor 7 includes an insertion portion **7*b* to be inserted into a concrete made construction, which insertion portion is formed at a distal end thereof with an expanding slot 7*a*, an arc-shaped head portion 7*c* and a tapered portion 7*d* connecting the insertion portion 7*b* to the head portion 7*c* and having a cross-sectional area increasing from the insertion portion 7*b* towards the head portion 7*c*. There is formed a through hole 7*e* axially extending through the anchor 7. The pin 8 is to be inserted into a concrete made construction through the through hole 7*e*. By forming the head portion 7*c* of the anchor 7 to be arc-shaped, it is possible to decrease the projecting length of the fixture 6 from a surface of the floor 1, and thus an amount of covering material to be applied to a lower surface of the floor 1** can be decreased by about 40% relative to a conventional hexagonal-shaped bolt.

The fixtures 6 are inserted into holes formed in the floor 1 at about 300 mm pitch, after the mesh-type reinforcing steel 5 is placed on a lower surface of the floor 1, with the tapered portions 7*d* of the anchors 7 being abutted to intersections of the mesh-type reinforcing steel 5. Thus, the mesh-type reinforcing steel 5 is fixed onto the floor 1. The tapered portion 7*d* having a cross-sectional area increasing towards the head portion 7*c* ensures that the tension force is imparted entirely to the mesh-type reinforcing steel 5 in a plane thereof in a direction indicated with arrows in FIG. 4. In the illustrated embodiment, the tension force is directed to outside from a span center C of the floor 1, that is, a point at which the concrete made construction has a maximum deflection caused by loads to be applied thereto and its own weight.

Figure 5:
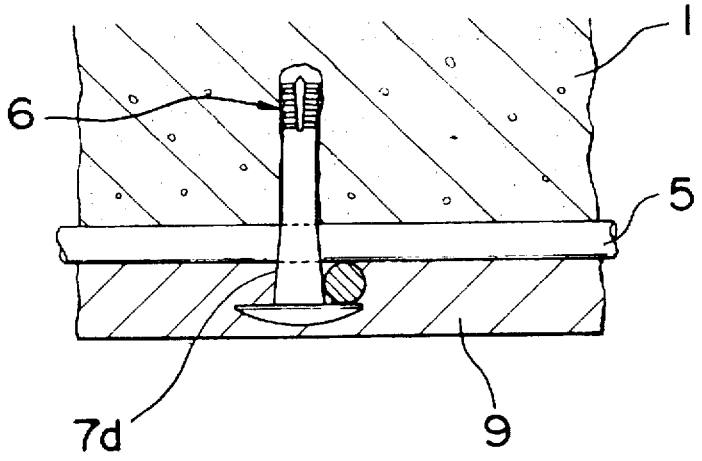
FIG. 5 is a cross-sectional view illustrating a concrete made construction reinforced with a fixture made in accordance with the present invention.

Then, as illustrated in FIG. 5, the mesh-type reinforcing steel 5 together with the fixtures 6 is entirely covered with a covering layer 9 composed of polymer cement mortar and having a thickness of about 20 mm. Thus, mending of the concrete made construction 1 is completed.

Figure 7:
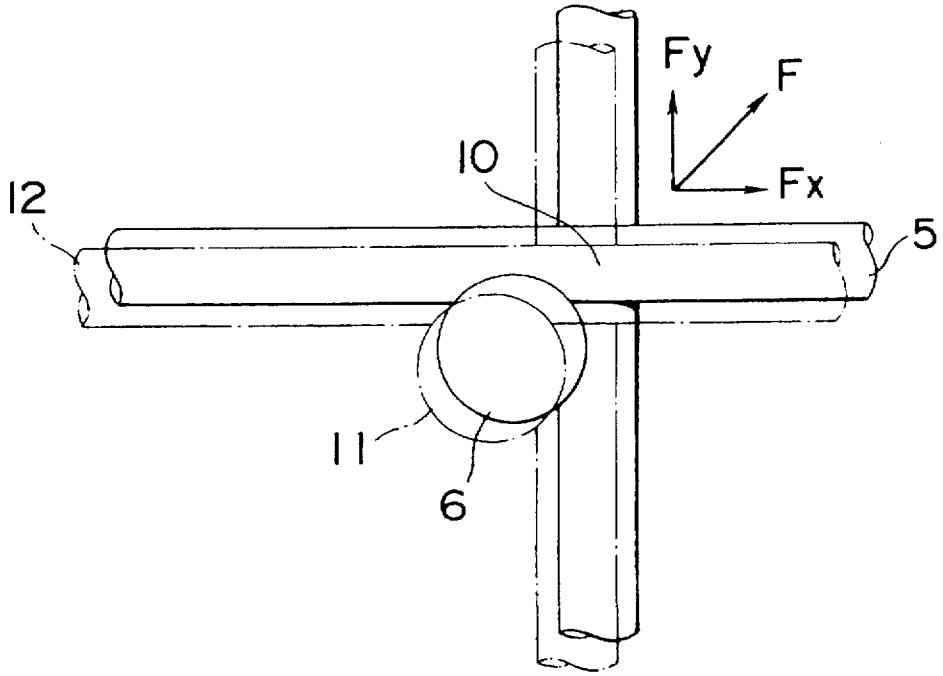
FIG. 7 illustrates behavior of a mesh-type reinforcing steel and a fixture made in accordance with the present invention, caused by deflection of a floor of a concrete made construction.

FIG. 7 illustrates behavior of the mesh-type reinforcing steel 5 and the fixture 6 caused by deflection of the floor 1 after the above mentioned mending has been completed. As illustrated, the fixture 6 imparts the tension force F to the intersection 10 of the mesh-type reinforcing steel 5 in a direction indicated with an arrow. Thus, the mesh-type reinforcing steel 5 is given pre-stresses Fx and Fy in x- and y-axes, respectively. Thus, when the fixture 6 is caused to move by the deflection of the floor 1 as shown with an alternate long and short dash line 11, the mesh-type reinforcing steel 5 follows the fixture 6 as shown with an alternate long and short dash line 12, thereby a gap being not produced between the mesh-type reinforcing steel 5 and the fixture 6 unlike the prior method.

A test was conducted to confirm the advantageous effects of the invention. A reinforcing steel of a concrete made construction had the tensile stress intensity of 20 tons, whereas a reinforcing steel reinforced in accordance with the present invention had 0.3 times greater stress intensity than the stress intensity of a reinforcing steel to which the present invention is not applied. Namely, there was obtained 70% reduction in tensile stress. Thus, it was confirmed that the method of the present invention prevents cracking of a floor of a construction such as a bridge, and hence keeps effective area of concrete unchanged, thereby preventing degradation of a floor caused by shearing and fatigue failure as well as bending.

Figure 8:
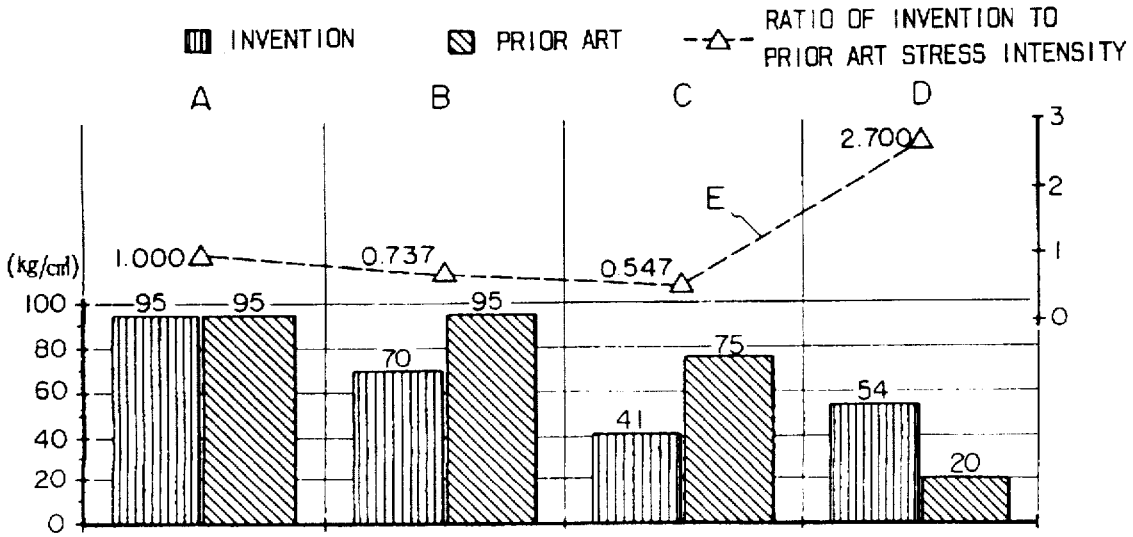
FIG. 8 is a graph showing how the stress of a reinforcing steel is changed both in a reinforcing method of the present invention and a conventional reinforcing method.

FIG. 8 is a graph showing how the stress of a reinforcing steel is changed both in a reinforcing method of the present invention and a conventional reinforcing method. In FIG. 8, sections A to C show stresses exerted on a mesh-type reinforcing stress in both the method of the present invention and a conventional method, before the method is applied, after a mesh-type reinforcing steel is fixed by means of a fixture, and after covering material is applied over a concrete made construction, respectively, and section D shows a difference in stress between before and after the method is applied both in the method of the present invention and a conventional method. Namely, the section D shows stress intensity reduction caused by applying the method to a mesh-type reinforcing steel. A polygonal line E shows a ratio of the stress intensity obtained by the method of the present invention to the stress intensity of a conventional method.

As will be obvious in view of the graph in FIG. 8, the stress intensity is reduced when a mesh-type reinforcing steel is fixed in accordance with the present invention, whereas the stress intensity remains unchanged when a mesh-type reinforcing steel is fixed in accordance with a conventional method. In addition, the method of the present invention provides 2.7 times greater reinforcement effect than a conventional method, which confirms that the present invention brings sufficient reinforcement effect. In accordance with the present invention, even if the method is applied to a mesh-type reinforcing steel while vehicles are running on a floor of a concrete made construction such as a bridge, the reinforcement effect can be found just after a mesh-type reinforcing steel is fixed. Furthermore, the advantageous effect caused by the formation of the covering layer is confirmed by the fact that strain caused by running vehicles at an interface between the covering layer and a surface of a concrete made construction is reduced by forming the covering layer over a concrete made construction.

It should be noted that the method of the present invention can be applied to reinforcement of a construction by adding reinforcing steels thereinto, as well as mending of a damaged concrete made construction. In addition, the application of the present invention is not to be limited to a floor of a bridge as described in the preferred embodiment. The method of the present invention can be applied to any concrete made construction. In particular, it is most effective to apply the invention to a floor which is repeatedly deflected by vehicles running thereon when a floor is being mended.

The present invention as described above provides advantages as follows.

By fixing a grating member such as a mesh-type reinforcing steel to a concrete made construction with the tension force being imparted to the grating member in a plane thereof, there is introduced pre-stress into the grating member. Thus, even if a concrete made construction to which the grating member is secured is deflected, the grating member moves following the deflection of the concrete made construction, thereby a gap being never generated between the grating member and a fixture. Hence, the fixation of the grating member to a concrete made construction can be enhanced, and thereby it is possible to maintain the reinforcing effect in a long time.

The fixture made in accordance with the present invention imparts pre-stress to a mesh-type reinforcing steel only by inserting to a concrete made construction. Thus, even if a concrete made construction to which the fixture is secured is deflected, the mesh-type reinforcing steel moves following the deflection of a concrete made construction, thereby a gap being never generated between the mesh-type reinforcing steel and the fixture. Hence, the fixation of the mesh-type reinforcing steel to a concrete made construction can be enhanced, and thereby it is possible to maintain the reinforcing effect in a long time. In particular, it is possible to certainly fix a mesh-type reinforcing steel to a floor of a bridge which would make deflection while fixtures are being secured thereto.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method of reinforcing a concrete construction, comprising the steps of:

(1) providing a reinforcing grating member, (2) providing a fixture having (a) an anchor having two ends, including an insertion portion at one end of the anchor, a head portion formed at the other end of the anchor, an expanding slot formed at one end of the insertion portion away from the head, a through hole formed axially through the anchor, and a tapered portion disposed between the insertion portion and the head portion and having a cross sectional area increasing from the insertion portion to the head portion; and (b) a pin constructed to fit in said through hole; and (3) fixing the grating member to a surface of the concrete construction with the fixture, whereby the tapered portion of the fixture is in contact with the grating member and a tension force is imparted to the grating member in a plane of the grating member.

2. A method according to claim 1, wherein the grating member comprises steel.

3. A method according to claim 1, wherein the grating member comprises resin.

4. A method according to claim 2, wherein the grating member comprises a steel grating formed by welding crossing steel members.

5. A method according to claim 1, wherein the grating member comprises intersections, and wherein said step of fixing is carried out so that the tapered portion of the fixture is in contact with the intersections of the grating member.

6. A method according to claim 2, wherein the grating member comprises intersections, and wherein said step of fixing is carried out so that the tapered portion of the fixture is in contact with the intersections of the grating member.

7. A method according to claim 3, wherein the grating member comprises intersections, and wherein said step of fixing is carried out so that the tapered portion of the fixture is in contact with the intersections of the grating member.

8. A method according to claim 4, wherein the grating member comprises intersections, and wherein said step of fixing is carried out so that the tapered portion of the fixture is in contact with the intersections of the grating member.

9. A method according to claim 1, wherein said step of fixing further comprises inserting the insertion portion of the anchor into the concrete construction, and driving the pin into the through hole to expand said expanding slot.

10. A method according to claim 5, wherein said step of fixing further comprises inserting the insertion portion of the anchor into the concrete construction, and driving the pin into the through hole to expand said expanding slot.

11. A method according to claim 1, wherein said tension force is imparted in a direction away from a point on said concrete construction having maximum deflection caused by loads applied to the concrete construction.

12. A method according to claim 5, wherein said tension force is imparted in a direction away from a point on said concrete construction having maximum deflection caused by loads applied to the concrete construction.

13. A method according to claim 1, further comprising the step, after said step of fixing, of applying a covering layer to said grating member.

14. A method according to claim 5, further comprising the step, after said step of fixing, of applying a covering layer to said grating member.

15. A method according to claim 13, therein said layer comprises a first layer for preventing corrosion of said grating member, a second layer for decreasing salt damage to said grating member, and a third layer for enhancing neutralization prevention effect, decreasing salt damage, and decreasing an alkaki-aggregate reaction.

16. A method according to claim 14, wherein said layer comprises a first layer for preventing corrosion of said grating member, a second layer for decreasing salt damage to said grating member, and a third layer for enhancing neutralization prevention effect, decreasing salt damage, and decreasing an alkaki-aggregate reaction.

* * * * *